US005362620A

United States Patent [19]

Lamotte et al.

[11] Patent Number: 5,362,620

[45] Date of Patent: Nov. 8, 1994

[54] PHOTOGRAPHIC MATERIAL CONTAINING A MIXTURE OF SILVER HALIDE EMULSIONS

[75] Inventors: Johan Lamotte, Leuven; Jean-Marie Dewanckele, Drongen, both of

[73] Assignee: Agfa-Gevaert, N.V., Mortsel,

[21] Appl. No.: 140,474

[22] Filed: Oct. 25, 1993

[30] Foreign Application Priority Data

Oct. 30, 1992 [EP] European Pat. Off. ..... 92203348.5

[51] Int. Cl.[5] ..... G03C 1/00; G03C 1/035

[52] U.S. Cl. ..... 430/571; 430/203; 430/230; 430/247; 430/611; 430/613

[58] Field of Search ..... 430/611, 571, 247, 204, 430/230, 613, 227, 203

[56] References Cited

U.S. PATENT DOCUMENTS 4,693,955 7/1987 Torizuka et al. ..... 430/204

5,006,455 4/1991 Pätzold et al. ..... 430/571

*Primary Examiner*—Thorl Chea

*Attorney, Agent, or Firm*—Breiner & Breiner

[57] ABSTRACT

The present invention discloses a photographic material comprising on a support a photosensitive layer containing a mixture of silver halide emulsions at least one of which is spectrally sensitized and at least one of which is not spectrally sensitized characterized in that the surface of the silver halide particles of the silver halide emulsion not being spectrally sensitized is loaded with a stabilizer having a mercapto group or the tautomeric thione group thereof such that the surface covered by one molecule of stabilizer is between 10 $Å^2$ and 70 $Å^2$. The loss of speed due to migration of the spectral sensitizer from the sensitized emulsion to the non sensitized emulsion is reduced and can even be inhibited.

6 Claims, No Drawings

PHOTOGRAPHIC MATERIAL CONTAINING A MIXTURE OF SILVER HALIDE EMULSIONS

DESCRIPTION

1. Field of the Invention

The present invention relates to a photographic material, in particular a silver salt diffusion transfer material, containing a light sensitive layer comprising a mixture of silver halide emulsions and to a method for obtaining an image therewith.

2. Background of the Invention

The principles of the silver complex diffusion transfer reversal process, hereinafter called DTR-process, have been described e.g. in U.S. Pat. No. 2,352,014 and the book "Photographic Silver Halide Diffusion Processes" by André Rott and Edith Weyde—The Focal Press—London and New York, (1972).

According to the DTR process, a silver complex salt is image-wise transferred by diffusion from the image-wise exposed silver halide emulsion layer into the image receiving layer, where it is converted to a silver image usually in the presence of physical development nuclei. For this purpose, the image-wise exposed silver halide emulsion layer is developed in the presence of a developing agent and non-developed silver halide is converted by means of a silver halide complexing agent into a soluble silver complex salt while in contact with an image receiving layer.

The DTR-image can be formed in the image-receiving layer of a sheet or web material which is a separate element with respect to the photographic silver halide emulsion material (a so-called two-sheet DTR element) disclosed in e.g. DE-A-2.346.378 or in the image-receiving layer of a so-called single-support-element, also called mono-sheet element, which contains at least one photographic silver halide emulsion layer integral with an image-receiving layer in water permeable relationship therewith. A DTR-image bearing material can be used as a planographic printing plate wherein the DTR-silver image areas form the water-repellant ink-receptive areas on a water-receptive ink-repellant surface.

Photographic materials containing in the light sensitive layer a mixture of silver halide emulsions whereby one of the silver halide emulsion may have a reduced speed with respect to the other are well known. For example photographic materials containing in the photosensitive or light sensitive layer a mixture of a light sensitive and a substantially light insensitive silver halide emulsion are well known in the art and are particularly useful in silver salt diffusion transfer materials. For example in U.S. Pat. No. 4,693,955 there is disclosed a monosheet silver salt diffusion transfer material for making a lithographic printing plate. According to said US-patent a light sensitive silver halide emulsion triggers the image-wise release of a silver complexing agent that subsequent to its release dissolves the substantially light insensitive silver halide and deposits it in the image receiving layer where the silver halide is reduced to silver.

In Japanese patent application laid-open to public inspection no. 15247/84 there is disclosed a photographic material containing a light sensitive and substantially light insensitive silver halide as a mixture in the photosensitive layer. Similar as in U.S. Pat. No. 4,693,955 the light sensitive silver halide emulsion triggers the image-wise release of a silver complexing agent that subsequent to its release dissolves the substantially light insensitive silver halide and deposits it as silver in the image receiving layer of an image receiving material.

In European patent application no. 0 527 521 there is disclosed a photographic material having a photosensitive layer containing a light sensitive and substantially light insensitive silver halide and a releasing compound that is capable of image-wise releasing a chemical sensitizer that renders the substantially light insensitive silver halide developable when released. Said release being triggered by the development of the light sensitive silver halide.

In order to obtain the desired difference in sensitivity between both silver halide emulsion only the light sensitive silver halide emulsion is spectrally sensitized. However when both emulsion are mixed a loss of sensitivity occurs probably due to migration of the spectral sensitizers from the surface of the light sensitive silver halide particles to the surface of the substantially light insensitive silver halide particles. This problem is especially apparent when the substantially light insensitive silver halide has an average diameter that is much less than that of the light sensitive silver halide emulsion.

The loss in sensitivity is especially apparent when the coating solution needs to be stored for some time before coating the photographic material.

SUMMARY OF THE INVENTION

It is an object of the present invention to provide a photographic material having a photosensitive layer containing a mixture of silver halide emulsions wherein at least one of the silver halide emulsions is spectrally sensitized whereas at least one of the other silver halide emulsion is not spectrally sensitized and which photographic material does not show the above disadvantage.

Further objects of the present invention will become clear from the description hereinafter.

According to the present invention there is provided a photographic material comprising on a support a photosensitive layer containing a mixture of silver halide emulsions at least one of which is spectrally sensitized and at least one of which is not spectrally sensitized characterized in that the surface of said silver halide particles of said silver halide emulsion not being spectrally sensitized is loaded with a stabilizer having a mercapto group or the tautomeric thione group thereof such that one molecule of stabilizer covers between 10 $Å^2$ and 70 $Å^2$ of said surface.

DETAILED DESCRIPTION OF THE INVENTION

It has thus been found that the loss of speed of a photographic material containing a mixture of silver halide emulsions whereby one of the silver halide emulsions is spectrally sensitized and one or more others are not can be reduced when the silver halide particles of (an) emulsion(s) not being spectrally sensitized are loaded, before mixing the emulsions, with a stabilizer having a mercapto group or the tautomeric thione group thereof so that one stabilizer molecule occupies 10 $Å^2$ to 70 $Å^2$, preferably 10 $Å^2$ to 60 $Å^2$ and most preferably 20 $Å^2$ to 50 $Å^2$ surface of the spectrally not sensitized silver halide particles per molecule of stabilizer. Outside the surface coverage range in accordance with the present invention substantial loss of speed occurs.

The surface coverage of 10 $Å^2$ to 70 $Å^2$ per molecule of stabilizer in connection with the present invention is the hypothetical surface coverage in the assumption that all of the stabilizer is adsorbed to the silver halide grains.

The present invention is especially suitable for use with photographic materials containing in the photosensitive layer a mixture of a light sensitive and a substantially light insensitive silver halide emulsion. By the term "substantially light insensitive" should be understood that no or practically no image is formed by the substantially light insensitive silver halide emulsion(s) under the same conditions for exposure and development of the light sensitive silver halide emulsion. Such will generally be the case when the difference in speed between the emulsions is at least a factor 10 and preferably at least a factor 100.

This difference in speed may be accomplished by using a coarse grain silver halide emulsion as the photosensitive emulsion and a fine grain emulsion as the substantially light insensitive silver halide emulsion. A coarse grain silver halide emulsion in connection with the present invention is a silver halide emulsion containing silver halide particles with an average diameter of at least 0.5 μm, preferably at least 0.8 μm whereas a fine grain emulsion contains silver halide particles having an average diameter of preferably not more than 0.3 μm and more preferably not more than 0.2 μm.

By the diameter of a silver halide grain is meant the diameter of a hypothetical sphere with an equivalent volume as the corresponding silver halide grain. The average diameter of the silver halide grains thus being the average of all these diameters. The average diameter can be measured according to e.g. the method described by G. Möller disclosed on the International Congress of Photographic Science (ICPS) held in Moskou from July 29th to Aug. 5, 1970.

The difference in speed may further be accomplished by desensitization of the silver halide grains of one of the emulsions to obtain the substantially light insensitive silver halide. Examples of desensitizing agent are disclosed in e.g. the U.S. Pat. Nos. 2,930,644, 3,431,111, 3,492,123, 3,501,310, 3,501,311, 3,574,629, 3,579,345, 3,598,595, 3,592,653, 4,820,625, 3,933,498, and GB 1.192.384. Further desensitizing agents suitable for use in accordance with the present invention are described e.g. by P. Glafkides in "Chimie et Physique Photographique", Paul Morttel, Paris (1967) .

The speed of a silver halide emulsion may also be reduced by doping the silver halide with e.g. $Rh^{3+}$, $Ir^{4+}$, $Cd^{2+}$, $Zn^{2+}$ or $Pb^{2+}$. As a further alternative the substantially light insensitive silver halide emulsion may be a so called primitive emulsion i.e. an emulsion not being chemically sensitized.

Stabilizers having a mercapto group suitable for use in connection with the present invention are preferably organic compounds containing a nitrogen containing heterocyclic groups e.g. oxazole, triazole, tetrazole, thiazole etc., etc. Examples of suitable stabilizers that can be used in connection with the present invention are mercaptothiazoles, mercaptobenzothiazoles, mercaptobenzimidazoles, mercaptothiadiazoles, mercaptotetrazoles, in particular 1-phenyl-5-mercapto-tetrazole, mercaptopyrimidines, mercaptotriazines, benzothiazoline-2-thione, oxazoline-thione etc.

The silver halides used in the present invention may comprise silver chloride, silver bromide, silver bromoiodide, silver chlorobromoiodide and the like, or mixtures thereof. To obtain a sufficiently high rate of solution of the silver halide and a satisfactory gradation necessary for graphic purposes a silver halide emulsion mainly comprising silver chloride is used preferably. This silver chloride emulsion may comprise up to 40 mole % preferably up to 20 mole % of silver bromide and/or up to 2% preferably up to 0.5% of silver iodide. The silver iodide is preferably contained on the surface of the silver halide grains.

The silver halide emulsions can be prepared by any of the well known procedures e.g. single jet emulsions, double jet emulsions such as Lippmann emulsions, ammoniacal emulsions, thiocyanate- or thioether-ripened emulsions such as those described in U.S. Pat. Nos. 2,222,264, 3,320,069, and 3,271,157. Surface image emulsions may be used or internal image emulsions may be used such as those described in U.S. Pat. Nos. 2,592,250, 3,206,313, and 3,447,927. If desired, mixtures of surface and internal image emulsions may be used as described in U.S. Pat. No. 2,996,382.

The silver halide particles of the photographic emulsions may have a regular crystalline foden such as cubic or octahedral form or they may have a transition form. Regular-grain emulsions are described e.g. in J. Photogr. Sci., Vol. 12, No. 5, Sept./Oct. 1964, pp. 242–251. The silver halide grains may also have an almost spherical form or they may have a tabular form (so-called T-grains), or may have composite crystal forms comprising a mixture of regular and irregular crystalline forms. The silver halide grains may have a multilayered structure having a core and shell of different halide composition. Besides having a differently composed core and shell the silver halide grains may comprise also different halide compositions and metal dopants inbetween.

The size distribution can be homodisperse or heterodispere. A homodisperse size distribution is obtained when 95% of the grains have a size that does not deviate more than 30% from the average grain size.

The emulsions can be chemically sensitized e.g. by adding sulphur-containing compounds during the chemical ripening stage e.g. allyl isothiocyanate, allyl thiourea, and sodium thiosulphate. Also reducing agents e.g. the tin compounds described in BE-A 493,464 and 568,687, and polyamines such as diethylene triaraine or derivatives of aminomethane-sulphonic acid can be used as chemical sensitizers. Other suitable chemical sensitizers are noble metals and noble metal compounds such as gold, platinum, palladium, iridium, ruthenium and rhodium. This method of chemical sensitization has been described in the article of R. KOSLOWSKY, Z. Wiss. Photogr. Photophys. Photochem. 46, 65–72 (1951).

The emulsions can also be sensitized with polyalkylene oxide derivatives, e.g. with polyethylene oxide having a molecular weight of 1000 to 20,000, or with condensation products of alkylene oxides and aliphatic alcohols, glycols, cyclic dehydration products of hexitols, alkyl-substituted phenols, aliphatic carboxylic acids, aliphatic amines, aliphatic diamines and amides. The condensation products have a molecular weight of at least 700, preferably of more than 1000. It is also possible to combine these sensitizers with each other as described in BE-A 537,278 and GB-A 727,982.

The spectral photosensitivity of the silver halide of the spectrally sensitized emulsion can be adjusted by proper spectral sensitization by means of the usual mono- or polymethine dyes such as acidic or basic cyanines, hemicyanines, oxonols, hemioxonols, styryl dyes or others, also tri- or polynuclear methine dyes e.g. rhodacyanines or neocyanines. Such spectral sensitizers have been described by e.g. F. M. HAMER in "The Cyanine Dyes and Related Compounds" (1964) Interscience Publishers, John Wiley & Sons, New York.

The spectrally sensitized silver halide emulsion(s) may also contain stabilizers e.g. homopolar or salt-like compounds of mercury with aromatic or heterocyclic rings such as mercaptotriazoles, simple mercury salts, sulphoniummercury double salts and other mercury compounds. Other suitable stabilizers are azaindenes, preferably tetra- or penta-azaindenes, especially those substituted with hydroxy or amino groups. Compounds of this kind have been described by BIRR in Z. Wiss. Photogr. Photophys. Photochem. 47, 2–27 (1952). Other suitable stabilizers are i.a. heterocyclic mercapto compounds e.g. phenylmercaptotetrazole, quaternary benzothiazole derivatives, and benzotriazole.

The silver halide emulsions may further contain either or not in combination with one or more developing agents pH controlling ingredients, and other ingredients such as antifogging agents, development accelerators, wetting agents, and hardening agents for gelatin.

The photosensitive layer in connection with the present invention may comprise light-screening dyes that absorb scattering light and thus promote the image sharpness and, as a consequence thereof, the sharpness of the final printed copy. Light-absorbing dyes that can be used as light-screening dyes have been described in i.a. U.S. Pat. Nos. 4,092,168, 4,311,787 and DE-A 2,453,217. More details about the composition, preparation and coating of silver halide emulsions can be found in e.g. Product Licensing Index, Vol. 92, December 1971, publication 9232, p. 107–109.

According to the present invention the spectrally and not spectrally sensitized silver halide emulsions are prepared separately and before mixing a stabilizer is added to the not spectrally sensitized silver halide emulsion(s) in an amount sufficient to obtain a coverage as described above.

The thus obtained coating solution for the photosensitive layer may then be coated to a support to obtain the photographic material according to the present invention.

Suitable supports for the photographic material in accordance with the present invention are e.g. a paper support such as e.g. a polyolefin coated paper or a organic resin support e.g. a polester film, a cellulose triacetate, polycarbonate film, polyamide etc.

In addition to the above described photosensitive layer other hydrophilic colloid layers in water permeable relationship therewith may be present. For example an antistatic and/or protective layer may be applied on top of the photosensitive layer. It is especially advantageous to include a base-layer between the support and the photosensitive silver halide emulsion layer. In a preferred embodiment of the present invention said base-layer serves as an antihalation layer. This layer can therefore contain the same light-absorbing dyes as described above for the photosensitive layer or as alternative finely divided carbon black can be used for the same antihalation purposes as described in U.S. Pat. No. 2,327,828. On the other hand, in order to gain sensitivity, light reflecting pigments, e.g. titaniumdioxide can be present. Further this layer can contain hardening agents, matting agents, e.g. silica particles, and wetting agents. At least part of these matting agents and/or light reflection pigments may also be present in the silver halide emulsion layer the most part however preferably being present in said base-layer. As a further alternative the light reflecting pigments may be present in a separate layer provided between the antihalation layer and the photosensitive silver halide emulsion layer.

Further the side of the support opposite to the photosensitive side may be provided with one or more backing layers that may include matting agents, developing agents, anti-sludge agents, antistatica etc.

The hydrophilic layers of the photographic material usually contain gelatin as hydrophilic colloid binder. Mixtures of different gelatins with different viscosities can be used to adjust the rheological properties of the layer. Like the emulsion layer the other hydrophilic layers on the photosensitive side are coated preferably at a pH value below the isoelectric point of the gelatin. Other hydrophilic colloid binders suitable for use in the hydrophilic layers are e.g. those mentioned for use in the backing layer(s).

The hydrophilic layers of the photographic element, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts of the type, described in U.S. Pat. No. 4,063,952.

Preferably used hardening agents are of the aldehyde type. The hardening agents can be used in wide concentration range but are preferably used in an amount of 4% to 7% of the hydrophilic colloid. Different amounts of hardener can be used in the different layers of the photographic material or the hardening of one layer may be adjusted by the diffusion of a hardener from another layer.

The photographic material according to the present invention is particularly suitable for use in a silver salt diffusion transfer process. For this purpose an image receiving layer containing physical development nuclei in water permeable relationship with the photosensitive layer may be included in the photographic element so that a monosheet DTR material is obtained.

Suitable physical development nuclei that can be used in such an image receiving layer are e.g. sulphides of hearty metals e.g. sulphides of antimony, bismuth, cadmium, cobalt, lead, nickel, palladium, platinum, silver, and zinc. Heavy metals, preferably silver, gold, platinum, palladium, and mercury can be used in colloidal form.

According to a preferred embodiment of the present invention the monosheet DTR-material comprises a photosensitive layer containing (i) light sensitive silver halide particles being spectrally sensitized and having an average diameter of at least 0.5 $\mu$m at a coverage of at least 0.2 g/m$^2$ and whereby the ratio of said coverage (in g/m$^2$) to said average diameter (in $\mu$m) is not more than 2 and (ii) substantially light insensitive silver salt not being spectrally sensitized having a speed of at least a factor 10 less than said light sensitive silver halide particles and being loaded with stabilizer in accordance with the present invention.

The image receiving layer may or may not contain a hydrophilic binder as described above. For example when the photographic material is intended to serve as a printing plate having the image receiving layer as an outermost layer it will preferably be free of binder. On the other hand when the photographic material is to be used for obtaining image the image receiving layer will preferably contain a binder.

According to another embodiment the image receiving layer may be present on a separate support of an image receiving material. Such image receiving materials are described in detail in e.g. European patent applications 218752, 208346, 218753 and U.S. Pat. No. 4,859,566.

Development of an information-wise exposed photographic material according to the present invention is accomplished using an alkaline processing liquid having a pH preferably between 9 and 13. The pH of the alkaline processing liquid may be established using various alkaline substances. Suitable alkaline substances are inorganic alkali e.g. sodium hydroxide, potassium carbonate or alkanolamines or mixtures thereof. Preferably used alkanolamines are tertiary alkanolamines e.g. those described in EP-A-397925, EP-A-397926, EP-A-397927, EP-A-398435 and U.S. Pat. No. 4,632,896. A combination of alkanolamines having both a $pk_a$ above or below 9 or a combination of alkanolamines whereof at least one has a $pk_a$ above 9 and another having a $pk_a$ of 9 or less may also be used as disclosed in the Japanese patent applications laid open to the public numbers 73949/61, 73953/61, 169841/61, 212670/60, 73950/61, 73952/61, 102644/61, 226647/63, 229453/63, U.S. Pat. Nos. 4,362,811, 4,568,634 etc. The concentration of these alkanolamines is preferably from 0.1 mol/l to 0.9 mol/l.

Suitable developing agents for the exposed silver halide are e.g. hydroquinone-type and 1-phenyl-3-pyrazolidone-type developing agents as well as p-monomethylaminophenol and derivatives thereof. Preferably used is a combination of a hydroquinone-type and 1-phenyl-3-pyrazolidone-type developing agent wherein the latter is preferably incorporated in one of the layers comprised on the support of the photographic material. A preferred class of 1-phenyl-3-pyrazolidone-type developing agents is disclosed in the European patent application number 449340. Other type of developing agents suitable for use in accordance with the present invention are reductones e.g. ascorbic acid derivatives. Such type of developing agents are disclosed in EP-A-498968.

The developing agent or a mixture of developing agents can be present in an alkaline processing solution, in the photographic material. In case the developing agent or a mixture of developing agents is contained in the photographic material, the processing solution can be merely an aqueous alkaline solution that initiates and activates the development.

The photographic material is treated in an acidic fixing bath containing a silver halide complexing agent such as e.g. thiosulphate. The photographic material may then be washed.

When the photographic material is to be used in a DTR-process the fixing step is not necessary but instead the development will be carried out in the presence of silver halide solvents generally included in the alkaline processing liquid. Suitable silver halide solvents for use in a DTR-process are e.g. thiosulphates, thiocyanates, thioethers. Other useful silver halide solvents (or "complexing agents") are described in the book "The Theory of the Photographic Process" edited by T. H. James, 4th edition, p. 474–475 (1977), in particular sulphites and uracil. Further interesting silver halide complexing agents are cyclic imides, preferably combined with alkanolamines, as described in U.S. Pat. Nos. 4,297,430 and 4,355,090. 2-mercaptobenzoic acid derivatives are described as silver halide solvents in U.S. Pat. No. 4,297,429, preferably combined with alkanolamines or with cyclic imides and alkanolamines.

The present invention will now be illustrated by way of the following examples without however limiting it thereto. All parts are by weight unless otherwise specified.

EXAMPLE 1

Preparation of the spectrally not sensitized silver chloride emulsion (a1).

| | | | |
|---|---|---|---|
| Solution A (35° C.): | water | | 500 ml |
| | $AgNO_3$ | 2.94 M (water) | 1000 ml |
| Solution B (35° C.): | water | | 500 ml |
| | NaCl | 3.94 M (water) | 790 ml |
| Solution C (35° C.): | water | | 2250 ml |
| | gelatin | | 70 g |

Solution C was brought to 45° C. and 65 ml of a solution containing 0.136% $Na_3RhCl_6$ was added. After adjusting the pH to 3.5 solution A and B were added simultaneously to solution C in ten minutes. The resulting emulsion was precipitated by adding polystyrene sulphonic acid. The precipitate was rinsed several times and redispersed by adding 180 g of gelatin to a final content of 200 g of $AgNO_3$ per kg of emulsion. The thus obtained emulsion was physically ripened for 2 hours. The average diameter of the grains was 0.174 μm.

Preparation of the spectrally not sensitized silver chloride emulsion (a2). This emulsion was prepared in the same way as the above mentioned emulsion (a1). The average diameter of the grains was 0.180 μm.

Preparation of the spectrally not sensitized silver chloride emulsion (a3). This emulsion was prepared in the same way as the above mentioned emulsion (a1). The average diameter of the grains was 0.182 μm.

Preparation of the spectrally sensitized silver halide emulsion (b1).

| | | | |
|---|---|---|---|
| Solution D (25° C.): | $AgNO_3$ | 2.94 M (water) | 1000 ml |
| Solution E (25° C.): | NaCl | 2.94 M (water) | 10.67 ml |
| Solution F (25° C.): | NaCl | 2.94 M (water) | 971.3 ml |
| | KBr | 2.94 M (water) | 18 ml |
| Solution G (60° C.): | water | | 1000 ml |
| | gelatin | | 50 g |
| Solution H (25° C.): | $AgNO_3$ | 2.94 M (water) | 1312.5 ml |
| Solution J (25° C.): | NaCl | 2.94 M (water) | 1275 ml |
| | KBr | 2.94 M (water) | 23.6 ml |
| Solution K (60° C.): | water | | 1000 ml |
| | gelatin | | 52.8 g |

Solution G and solution K were adjusted to pAg=100 mV with solution E and to pH=4 with $H_2SO_4$ (3 mol/l). Solution D was added to solution G at a constant rate of 5.33 ml per minute for 120 seconds, while solution E was added at a rate so as to keep the pAg at 100 mV. The solution was then physically ripened for 79 seconds at 60° C. Solution D was further added in 4048 seconds at an accelerating rate from 5.33 to 24 ml per minute, while solution F was further added at a rate so as to keep the pAg at 100 mV. The resulting emulsion was precipitated by adding polystyrene sulphonic acid. The precipitate was rinsed several times with a NaCl solution in water (8.8 mmol/l) and redispersed by adding 68.5 g of gelatin to a final content of 281 g of $AgNO_3$ per kg of emulsion. A silver halide emulsion containing 98.2% of silver chloride and 1.8% of silver bromide with an average diameter of the grains of 0.48 μm was thus obtained. 337.5 g of this emulsion was added to solution K and the pAg is adjusted to 100 mV with NaCl (3.94 mol/l) and the pH is adjusted to 4 with $H_2SO_4$ (3 mol/l). Solution H was then added in 5250 seconds at an accelerating rate from 6 to 24 ml per minute, while solution J was further added at a rate so as to keep the pAg at 100 mV. The resulting emulsion was precipitated by adding polystyrene sulphonic acid. The precipitate was rinsed several times with a NaCl solution in water (8.8 mmol/l) and redispersed by adding 300 g of gelatin to a final content of 197 g of $AgNO_3$ per kg of emulsion. A silver halide emulsion containing 98.2 mole % of silver chloride and 1.8 mole % of silver bromide with an average diameter of the grains of 1.02 μm was thus obtained. This emulsion was chemically sensitized, spectrally sensitized with ortho sensitizer I ($1.8\times10^{-6}$ mol per gram of $AgNO_3$) at pH=4 and stabilized with II ($1.5\times10^{-6}$ mol per gram of $AgNO_3$) and III ($3.5\times10^{-6}$ mol per gram of $AgNO_3$).

I =

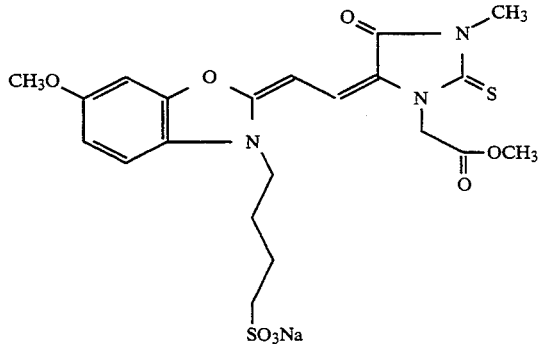

II = 1-phenyl-5-mercaptotetrazole

III = $NaO_3S$

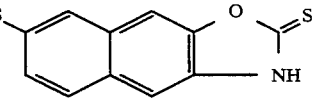

Preparation of the spectrally sensitized silver chloride emulsion (b2).

| | | | |
|---|---|---|---|
| Solution L (25° C.): | $AgNO_3$ | 2.94 M (water) | 1000 ml |
| Solution M (25° C.): | water | | 192 ml |
| | NaCl | 3.94 M (water) | 808 ml |
| Solution N (35° C.): | water | | 575 ml |
| | gelatin | | 46 g |
| | methionine | 25 g/l (water) | 200 ml |
| | NaCl | 3.94 M (water) | 10 ml |
| Solution P (25° C.) | $AgNO_3$ | 2.94 M (water) | 2000 ml |
| Solution Q (25° C.): | water | | 384 ml |
| | NaCl | 3.94 M (water) | 1616 ml |
| Solution R (35° C.): | water | | 400 ml |

-continued

Preparation of the spectrally sensitized silver chloride emulsion (b2).

| | |
|---|---|
| gelatin | 92 g |

Solution N and R were brought to 60° C. Solution L was then added in 50 minutes and solution M in 48 minutes to solution N. The thus obtained emulsion was physically ripened for 25 minutes at 60° C. Then after adding solution R the emulsion was stirred for 5 minutes. Solution P was then added in 50 minutes and solution Q in 48 minutes to the emulsion. Physical ripening was carried out foe 15 minutes at 60° C. The resulting emulsion was precipitated by adding polystyrene sulphonic acid. The precipitate was rinsed several times and redispersed by adding 612 g of gelatin to a final content of 170 g of $AgNO_3$ per kg of emulsion. Silver chloride grains with an average diameter of 0.94 μm were obtained. This emulsion was chemically sensitized, spectrally sensitized with ortho sensitizer I ($1.9\times10^{-6}$ mol per gram of $AgNO_3$) at pH=4 and stabilized with II ($1.8\times10^{-6}$ mol per gram of $AgNO_3$) and III ($3.6\times10^{-6}$ mol per gram of $AgNO_3$).

The samples were prepared as follows. To a polyethylene terephthalate film support coated with a hydrophillic adhesion layer was coated a layer comprising a mixture of spectrally not sensitized emulsion and spectrally sensitized emulsion. The layers were coated at pH=4 and contain gelatin in an amount of 2.6 gram of gelatine per $m^2$. The samples differ in the amount of stabilizer for the spectrally not sensitized emulsion and/or the kind of stabilizer for the spectrally not sensitized emulsion and/or the kind of spectrally not sensitized emulsion and/or the amount of spectrally not sensitized emulsion and/or the kind of spectrally sensitized emulsion as shown in table 1

TABLE 1

| | Emulsion | | | | | |
|---|---|---|---|---|---|---|
| | Spectrally sensitized | | Spectrally not sensitized | | | |
| sample | kind | AgX g/m²* | kind | AgX g/m²* | stabiliser kind | surface coverage** |
| S0A | b2 | 2 | / | 0 | / | 0 |
| S0B | b2 | 2 | a3 | 1 | / | 0 |
| S0C | b1 | 2 | / | 0 | / | 0 |
| S1A | b2 | 2 | a3 | 1 | SI | 40 |
| S1B | b2 | 2 | a3 | 1 | SI | 27 |
| S2 | b2 | 2 | a3 | 1 | SII | 40 |
| S3 | b2 | 2 | a3 | 1 | SIII | 40 |
| S4 | b2 | 2 | a3 | 1 | SIV | 40 |
| S5A | b2 | 2 | a3 | 1 | SV | 40 |
| S5B | b2 | 2 | a3 | 1 | SV | 27 |
| S6A | b2 | 2 | a3 | 1 | SVI | 40 |
| S6B | b2 | 2 | a3 | 1 | SVI | 27 |
| S7 | b2 | 2 | a3 | 1 | SVII | 40 |
| S8A | b2 | 2 | a3 | 1 | SVIII | 40 |
| S8B | b1 | 2 | a2 | 1 | SVIII | 5 |
| S8C | b1 | 2 | a2 | 1 | SVIII | 10 |
| S8D | b1 | 2 | a2 | 1 | SVIII | 20 |
| S8E | b1 | 2 | a2 | 1 | SVIII | 40 |
| S8F | b1 | 2 | a2 | 1 | SVIII | 60 |
| S8G | b1 | 2 | a2 | 1 | SVIII | 80 |
| S8H | b1 | 2 | a2 | 1 | SVIII | 100 |
| S9 | b2 | 2 | a3 | 1 | SIX | 40 |
| S10 | b1 | 2 | a1 | 1 | SX | 40 |
| S11A | b1 | 2 | a1 | 1 | SXI | 40 |
| S11B | b2 | 2 | a3 | 1 | SXI | 52 |
| S12A | b1 | 2 | a1 | 1 | SXII | 40 |
| S12B | b1 | 2 | a1 | 1 | SXII | 27 |
| S13 | b1 | 2 | a1 | 1 | SXIII | 40 |
| S14A | b1 | 2 | a1 | 1 | SXIV | 40 |
| S14B | b1 | 2 | a1 | 1 | SXIV | 27 |

TABLE 1-continued

| | | | | | | |
|---|---|---|---|---|---|---|
| S15A | b1 | 2 | a1 | 1 | SXV | 40 |
| S15B | b1 | 2 | a1 | 1 | SXV | 27 |
| S16A | b1 | 2 | a1 | 1 | SXVI | 40 |
| S16B | b1 | 2 | a1 | 1 | SXVI | 27 |
| S17 | b1 | 2 | a1 | 1 | SXVII | 40 |
| S18 | b1 | 2 | a1 | 1 | SXVIII | 40 |

*The amount of silver halide (AgX) is expressed as the corresponding amount of $AgNO_3$.

**The surface coverage is the amount of surface of spectrally not sensitized silver halide particles occupied by one molecule stabiliser, in the assumption that all of the stabilizer is adsorbed to the spectrally not sensitized silver halide grains, it is expressed in $A^2$ per molecule stabilizer.

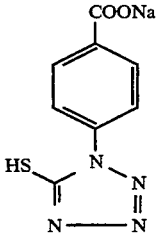

(SI)

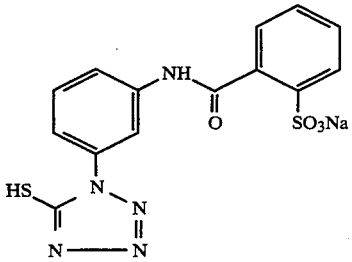

(SII)

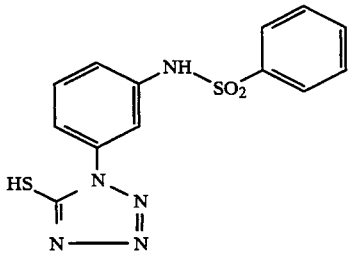

(SIII)

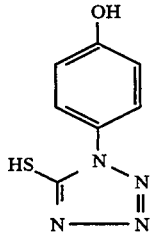

(SIV)

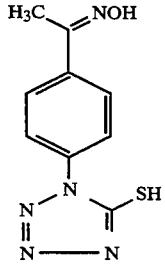

(SV)

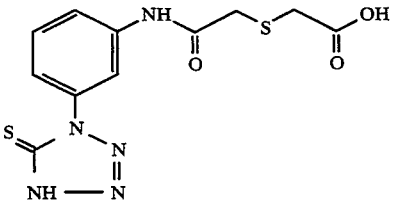

(SVI)

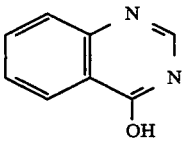

(SVII)

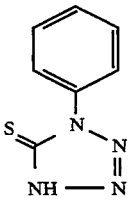

(SVIII)

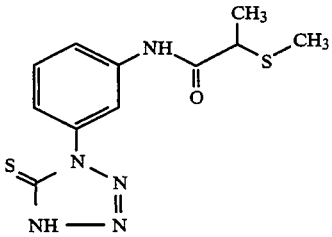

(SIX)

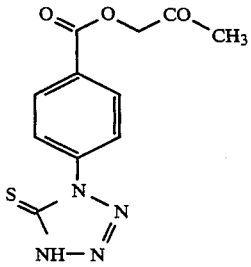

(SX)

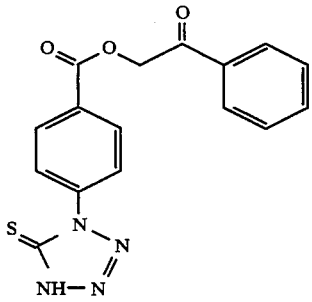

(SXI)

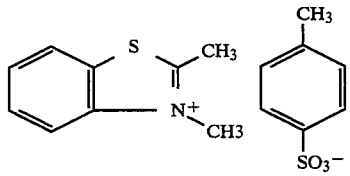

(SXII)

TABLE 1-continued

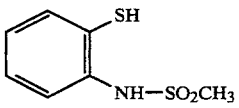

(SXIII)

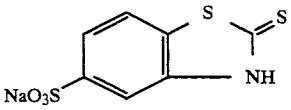

(SXIV)

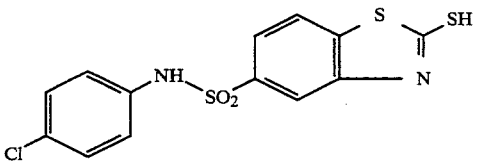

(SXV)

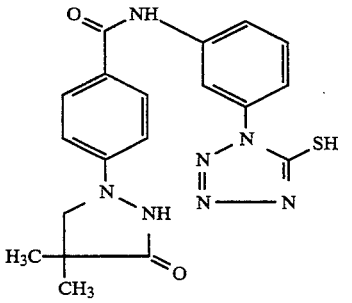

(SXVI)

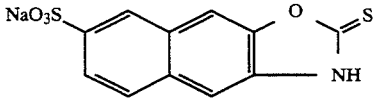

(SXVII)

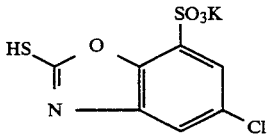

(SXVIII)

The stabilisation of the spectrally not sensitized emulsion is carried out by stirring the mixture of the spectrally not sensitized emulsion and the stabiliser for one hour at 38° C. This stabilisation is carried out before mixing the spectrally sensitized and spectrally not sensitized emulsions.

For the samples as described in table 1, we investigated 2 variants differing in the time that the coating solution was left to stand before coating the mixture of the spectrally sensitized and the spectrally not sensitized emulsion.

All the samples were exposed for $10^{-5}$ seconds with a Xenon flash through a U460 filter and a continuous widge (widgeconstant=0.20).

After the exposure the samples were subsequently developed using an alkaline developer liquid containing hydroquinone and 1-phenyl-3-pyrazolidinone as developing agents and fixed using a fixing solution containing thiosulphate.

For each of the samples the speed was measured. The results are shown in table 2.

TABLE 2

| sample | speed (relative logIt)* after standing x minutes 0 | 254 | Δspeed** |
|---|---|---|---|
| S0A | 1.20 | 1.28 | 0.08 |
| S0B | 1.31 | 3.20 | 3.00 |
| S0C | 1.88 | 1.95 | 0.07 |
| S1A | 1.12 | 1.37 | 0.17 |
| S1B | 1.13 | 1.43 | 0.23 |
| S2 | 1.28 | 1.35 | 0.15 |
| S3 | 1.35 | 1.62 | 0.42 |
| S4 | 1.41 | 1.77 | 0.57 |
| S5A | 1.25 | 1.54 | 0.34 |
| S5B | 1.33 | 1.57 | 0.37 |
| S6A | 1.24 | 1.50 | 0.30 |
| S6B | 1.28 | 1.75 | 0.55 |
| S7 | 1.39 | 3.37 | 3.17 |
| S8A | 1.43 | 1.93 | 0.73 |
| S8B | 1.89 | 3.04 | 1.16 |
| S8C | 1.89 | 2.42 | 0.54 |
| S8D | 1.86 | 2.19 | 0.31 |
| S8E | 1.85 | 2.09 | 0.21 |
| S8F | 1.85 | 2.14 | 0.26 |
| S8G | 1.83 | 3.02 | 1.14 |
| S8H | 1.91 | 2.88 | 1.00 |
| S9 | 1.38 | 1.75 | 0.55 |
| S10 | | 1.91 | 0.03 |
| S11A | | 1.97 | 0.46 |
| S11B | 1.38 | 1.76 | 0.56 |
| S12A | | 2.46 | 1.15 |
| S12B | | 2.58 | 1.13 |
| S13 | | 2.05 | 0.64 |
| S14A | | 1.95 | 0.22 |
| S14B | | 1.97 | 0.27 |
| S15A | | 1.94 | 0.32 |
| S15B | | 1.97 | 0.34 |
| S16A | | 1.77 | −0.05 |
| S16B | | 1.79 | −0.07 |
| S17 | | 1.91 | 0.23 |
| S18 | | 2.20 | 0.76 |

*The speed is the relative logIt value for which the density equals ($D_{MIN}$ + 0.05). The lower the number the higher the speed.

**Δspeed is the difference between the speed of the sample after 254 minutes mixing and the speed of the corresponding spectrally sensitized emulsion in the absence of spectrally not sensitized emulsion (sample S0A or S0C; 0 minutes mixing).

From the comparison sample SOB in table 2 it can be seen that a mixture of spectrally sensitized emulsion and spectrally not sensitized and not stabilized emulsion loses speed with increasing standing time before coating of the spectrally sensitized and the spectrally not sensitized emulsions. As can be seen from samples S1 to S6 and S8 to S18, this loss of speed is greatly reduced or even inhibited when the silver halide particles of the emulsion not being spectrally sensitized are loaded, before mixing the emulsions, with a stabilizer having a mercapto group. The reduction of speed loss is only obtained if the surface coverage is between 10 Å$^2$ and 70 Å$^2$ per molecule as can be seen from sample S8B to S8H.

EXAMPLE 2

A spectrally not sensitized silver chloride emulsion (a4) was prepared in a similar way as the in example 1 mentioned emulsion (a1). The average diameter of the grains was 0.154 μm.

4 different samples were prepared as follows. To a polyethylene terephthalate film support coated with a hydrophillic adhesion layer were coated in the order given (1) a layer comprising a mixture of the above described substantially light insensitive silver chloride emulsion (a4) and the in example 1 described photosensitive silver halide emulsion (b1), (2) a layer of physical development nuclei. The type of physical development nuclei was PdS.

The composition of each of these different layers is shown in table 3.

TABLE 3

| compound: | layer number (1) | (2) |
|---|---|---|
| gelatin ($g/m^2$) | 2.6 | 0.5 |
| nuclei ($\mu mol/m^2$)* | / | 10 |
| emulsion a4: AgX ($g/m^{2**}$) | 1 | / |
| emulsion b1: AgX ($g/m^{2**}$) | 0.5 | / |
| IV ($\mu mol/m^2$) | 95 | 38.6 |

IV = $C_7H_{15}$-$COONH_4$

*Amount of nuclei is expressed as amount of sulphide-ion.

**The amount of silver halide is expressed as the corresponding amount of $AgNO_3$.

The 4 samples differ in the stabilisation of the spectrally not sensitized emulsion and/or the time left to stand before coating of the mixture of spectrally sensitized and spectrally not sensitized emulsion as shown in table 4.

TABLE 4

| Sample | time left to stand (minutes) | Stabilizer kind | surface coverage* |
|---|---|---|---|
| S19 | 30 | / | / |
| S20 | 60 | / | / |
| S21 | 30 | SVIII | 40 |
| S22 | 60 | SVIII | 40 |

*The surface coverage is the amount of surface of spectrally not sensitized silver halide particles occupied by one molecule stabiliser, in the assumption that all of the stabilizer is adsorbed to the spectrally not sensitized silver halide grains; it is expressed in $Å^2$ per molecule stabilizer.

The stabilisation of the spectrally not sensitized emulsion was carried out by stirring the mixture of the spectrally not sensitized emulsion and the stabiliser for one hour at 38° C. This stabilisation was carried out before fixing the spectrally sensitized and spectrally not sensitized emulsions.

The samples were exposed (EG&G; $10^{-5}$ sec; U460 filter) through a discontinuous widge (widgeconstant=0.15) and subsequently developed using an alkaline developer liquid CP297b (commercially available from Agfa-Gevaert N.V.) containing hydroquinone and 1-phenyl-4-methyl-3-pyrazolidone as developing agents and thiosulphate as a silver halide solvent and fixed using a fixing solution containing thiosulphate. High speed direct-positive materials were obtained. For each of the samples the minimum and maximum transmission density and the speed were measured. These results are shown in table 5.

TABLE 5

| Sample | $D_{MAX}$ | $D_{MIN}$ | SPEED* |
|---|---|---|---|
| S19 | 1.33 | 0.18 | 10 |
| S20 | 1.32 | 0.20 | 6 |
| S21 | 2.30 | 0.15 | 10 |

TABLE 5-continued

| Sample | $D_{MAX}$ | $D_{MIN}$ | SPEED* |
|---|---|---|---|
| S22 | 2.31 | 0.15 | 10 |

*The speed is expressed as number of widgeconstants for which the density equals $D_{MIN}$ + 0.1. The higher the number the higher the speed.

As can be seen from sample S21 and S22 there is no loss of speed when the spectrally not sensitized emulsion is stabilized.

We claim:

1. A photographic material comprising on a support a photosensitive layer containing a mixture of silver halide emulsions at least one of which is spectrally sensitized and at least one of which is not spectrally sensitized wherein the surface of said silver halide particles of said silver halide emulsion not being spectrally sensitized is loaded with a stabilizer having a mercapto group or the tautomeric thione group thereof such that one molecule of stabilizer covers between 10 $Å^2$ and 70 $Å^2$ of said surface, and wherein said silver halide emulsion being spectrally sensitized has an average diameter of at least 0.5 μm and said silver halide emulsion not being spectrally sensitized having an average diameter of not more than 0.3 μm.

2. A photographic material according to claim 1 wherein said surface covered by one molecule of stabilizer is between 20 $Å^2$ and 50 $Å^2$.

3. A photographic material according to claim 1 wherein said silver halide emulsion not being spectrally sensitized has a speed at least a factor 10 less than said silver halide emulsion being spectrally sensitized.

4. A photographic material according to claim 1 further comprising an image receiving layer containing physical development nuclei.

5. A method of obtaining an image comprising the steps of image-wise exposing a photographic material comprising on a support a photosensitive layer containing a mixture of silver halide emulsions at least one of which is spectrally sensitized and at least one of which is not spectrally sensitized wherein the surface of said silver halide particles of said silver halide emulsion not being spectrally sensitized is loaded with a stabilizer having a mercapto group or the tautomeric thione group thereof such that one molecule of stabilizer covers between 10 $Å^2$ and 70 $Å^2$ of said surface and developing a thus obtained image-wise exposed photographic material in the presence of one or more developing agents, and wherein said silver halide emulsion being spectrally sensitized has an average diameter of at least 0.5 μm and said silver halide emulsion not being spectrally sensitized having an average diameter of not more than 0.3 μm.

6. A method for obtaining an image according to claim 5 wherein said photographic material further comprises an image receiving layer containing physical development nuclei and in the presence of one or more developing agents and one or more silver halide solvents.

* * * * *